US012337248B1

(12) United States Patent
Sleadd et al.

(10) Patent No.: US 12,337,248 B1
(45) Date of Patent: Jun. 24, 2025

(54) GRAVITY-POWERED ZIP LINE TROLLEY RETURN SYSTEM

(71) Applicant: Sleaddventures, LLC, Grants Pass, OR (US)

(72) Inventors: Nathan Graham Sleadd, Grants Pass, OR (US); Robert Leon Mortimore, Grants Pass, OR (US)

(73) Assignee: SLEADDVENTURES, LLC, Grants Pass, OR (US)

( * ) Notice: Subject to any disclaimer, the term of this patent is extended or adjusted under 35 U.S.C. 154(b) by 581 days.

(21) Appl. No.: 17/888,814

(22) Filed: Aug. 16, 2022

Related U.S. Application Data

(60) Provisional application No. 63/288,142, filed on Dec. 10, 2021.

(51) Int. Cl.
*A63G 21/22* (2006.01)
*B61B 7/00* (2006.01)
*B61H 9/02* (2006.01)

(52) U.S. Cl.
CPC ..... *A63G 21/22* (2013.01); *B61B 7/00* (2013.01); *B61H 9/02* (2013.01)

(58) Field of Classification Search
CPC ..... B61B 7/00; A63G 21/20; A63G 21/22; B61H 9/02
USPC ..... 104/112, 113, 117.1; 188/174
See application file for complete search history.

(56) References Cited

U.S. PATENT DOCUMENTS 1,636,794 A 11/1925 Waters
1,769,849 A 7/1927 Liddiard
1,873,196 A * 8/1932 Harris ..... A62B 1/10 441/84
5,638,755 A * 6/1997 Love ..... A63G 21/22 104/126
7,802,658 B2 9/2010 Aulanko et al.
8,807,292 B2 8/2014 Liston et al.
9,573,605 B2 * 2/2017 Steele ..... A63G 21/22
(Continued)

FOREIGN PATENT DOCUMENTS

WO WO-2005092459 A1 * 10/2005 ..... A63G 21/22

*Primary Examiner* — Zachary L Kuhfuss
(74) *Attorney, Agent, or Firm* — Jerry Haynes Law

(57) ABSTRACT

A gravity-powered zip line trolley return system for a zip line system having a zip line cable and a trolley configured to traverse the zip line cable may include a mounting block detachably mountable to the zip line cable of the zip line system. A spool bracket may be supported by the mounting block. A first spool may be supported by the spool bracket. A second spool supported by the spool bracket, wherein the first spool and the second spool are rotationally coupled to each other through a gear reduction ratio mechanism and a drive belt. A trolley return line may be windable on the first spool and connectable to the trolley of the zip line system. The trolley return line may be configured to move with the trolley in a forward movement and to pull the trolley in a backward movement as the first spool rotates. A counterweight suspension element may be windable on the second spool. A counterweight may be attached to the counterweight suspension element. The counterweight suspension element may balance the counterweight against gravity depending on rotation of the gear reduction ratio mechanism with respect to the forward or backward movement of the trolley return line with the trolley.

20 Claims, 3 Drawing Sheets

(56) References Cited

U.S. PATENT DOCUMENTS

| | | | | |
|---|---|---|---|---|
| 9,579,578 | B2 | 2/2017 | Chasteen | |
| 9,789,410 | B2 | 10/2017 | Dose et al. | |
| 9,814,989 | B2 | 11/2017 | Gustafson | |
| 2002/0162477 | A1* | 11/2002 | Palumbo | B61B 7/00 104/87 |
| 2009/0255436 | A1 | 10/2009 | Buckman | |
| 2019/0322293 | A1 | 10/2019 | Chasteen | |

* cited by examiner

GRAVITY-POWERED ZIP LINE TROLLEY RETURN SYSTEM

FIELD OF THE INVENTION

The present invention relates generally to transport apparatuses and systems having a trolley that traverses a suspended cable. More specifically, the present invention relates to a gravity-powered zip line trolley return system which utilizes gravity to facilitate return of a trolley from the ending position to the starting position on a zip line cable in a zip line system.

BACKGROUND OF THE INVENTION

Generally, a "zip line" includes a trolley which is movably suspended on a cable that is erected over an inclined area. The zip line enables a rider who is supported by the trolley to be propelled by gravity from a starting position at the top to an ending position at the bottom of the inclined cable. Zip lines come in many forms and are most often used as a means of entertainment. They may be short and low, as found on some playgrounds, or longer and higher in the case of amusement rides for adults. A rider initially boards the trolley at the starting position at the top of the inclined cable, and the trolley then traverses the cable to the bottom of the cable under the influence of gravity. After the rider reaches the ending position at the bottom end of the zip line cable, the trolley must be returned to the starting position in preparation for another ride.

Returning the trolley from the ending position to the starting position of the zip line cable has been accomplished by several means. In simple low to the ground installations, the return can be affected by pushing the trolley back to the top of the cable on foot. The return has also been conducted with a line leading from the trolley to the uphill end of the line. In other installations, the trolley may be removed from the zip line, transported in some manner to the top of the cable and reattached to the cable.

It is known in the art that returning a zip line trolley from the ending position to the elevated starting position along the zip line cable is typically the most challenging and time-consuming aspect of a zip line's operation. Generally, after completion of the ride, the trolley is disconnected at the lower end of the cable at the ending position, carried back up to the high point, and then reconnected to the upper end of the cable at the starting position. Otherwise, the trolley may be pulled to the upper end of the cable using a drag line or separate retrieval device.

Numerous attempts have been made and several prior art devices are known in the art for returning a trolley to the top of a zip line cable in a zip line transportation system. A number of patents and patent applications which are pending and issued disclose solutions to slowing and braking a zip line rider as the trolley traverses the zip line cable. Even though these innovations may be suitable for the specific purposes to which they address, however, they would not be as suitable for the purposes of the present invention.

For example, U.S. Pat. No. 1,636,794 to Waters discloses an apparatus for use in taking down glass cylinders which have been drawn from a molten bath. The apparatus includes a hole-end sling, a hoisting cable and guide rope attached thereto. A counter-weight cable is attached to the sling to allow the sling to move upward along the length of a freshly drawn cylinder.

U.S. Pat. No. 1,769,849 to Liddiard discloses remotely controlled electrical braking devices of winders, cranes, lifts, and the like.

U.S. Pat. No. 7,802,658 to Aulanko et al. discloses an elevator cable tensioning device.

U.S. Pat. No. 8,807,292 to Liston et al. discloses a zip line braking system that reduces the speed of a zip liner by lifting chain links from a chain reservoir.

U.S. Pat. No. 9,573,605 to Steele et al. discloses a continuous assist braking and control system operable to control the movement, speed, and acceleration of a zipline rider traversing a zipline.

U.S. Pat. No. 9,789,410 to Dose et al. teaches an auto reset zip line assembly including a cable which runs along the circumference of two pulleys that are spaced apart from each other, forming a closed loop. A pair of rigid frames is fixedly coupled to the cable at an equal distance from each other. The auto reset zip line assembly further includes a braking mechanism and a pair of guarding plates coupled to the housing to prevent derailing and entangling of the cable.

U.S. Pat. No. 9,814,989 to Gustafson discloses a recreational zip line system, and more particularly, to a portable structure used to support a zip line. The portable zip line structure includes a tower structure having at least one platform mounted partially within an interior space of the tower structure.

U.S. Pat. Published App. No. 20020162477 to Palumbo describes a high-speed dual cable zip line ride in which the participant(s) ascends by a mechanical motor drive system and descends using a combination of mechanical and gravitational forces.

U.S. Pat. Published App. No. 20090255436 to Buckman discloses a zipline braking system having one load carrying cable and at least one overhead member. A stopping member that is attached to the cable and a suspender are attached to the overhead member such that when the zipline moves toward the finish end of the cable, the rope pulls a counterweight against the force of gravity to decelerate the speed of the zipline.

U.S. Pat. Published App. No. 20190322293 to Chasteen discloses a zip line that includes a cable having a load carrying trolley, a plurality of idler pulleys, a motor driven drive wheel disposed intermediate the idler pulleys that engages the lower side of the cable, and a remotely operable control electrically connected to the motor for operatively rotating the drive wheel and propelling the retriever.

U.S. Pat. No. 9,579,578 to Chasteen describes a zip line trolley retriever system comprising a remote-controlled trolley retriever having reversible drive means operatively engaging the sheave means for propelling the retriever up and down the zip line.

These types of zip line systems and devices provide the option of braking and effectively controlling the zip line in different situations, whether for recreational or safety purposes; however, none of these examples attempts to address the problems identified and addressed by the present invention. They fail to provide a solution that facilitates easy, quick, and automatic return of the trolley system to the starting position without requiring the use of electrical power, thereby allowing convenient zip line reset.

Accordingly, there exists a need for a gravity-powered zip line trolley return system which utilizes gravity to facilitate return of a trolley from the ending position to the starting position on a zip line cable in a zip line system.

BRIEF DESCRIPTION OF THE DRAWINGS

To further clarify various aspects of some example embodiments of the present invention, a more particular description of the invention will be rendered by reference to specific embodiments thereof, which are illustrated in the appended drawing. It is appreciated that the drawings depict only illustrated embodiments of the invention, and are therefore not to be considered limiting of its scope. The invention will be described and explained with additional specificity and detail with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting unless the claims expressly state otherwise.

Figure 1:
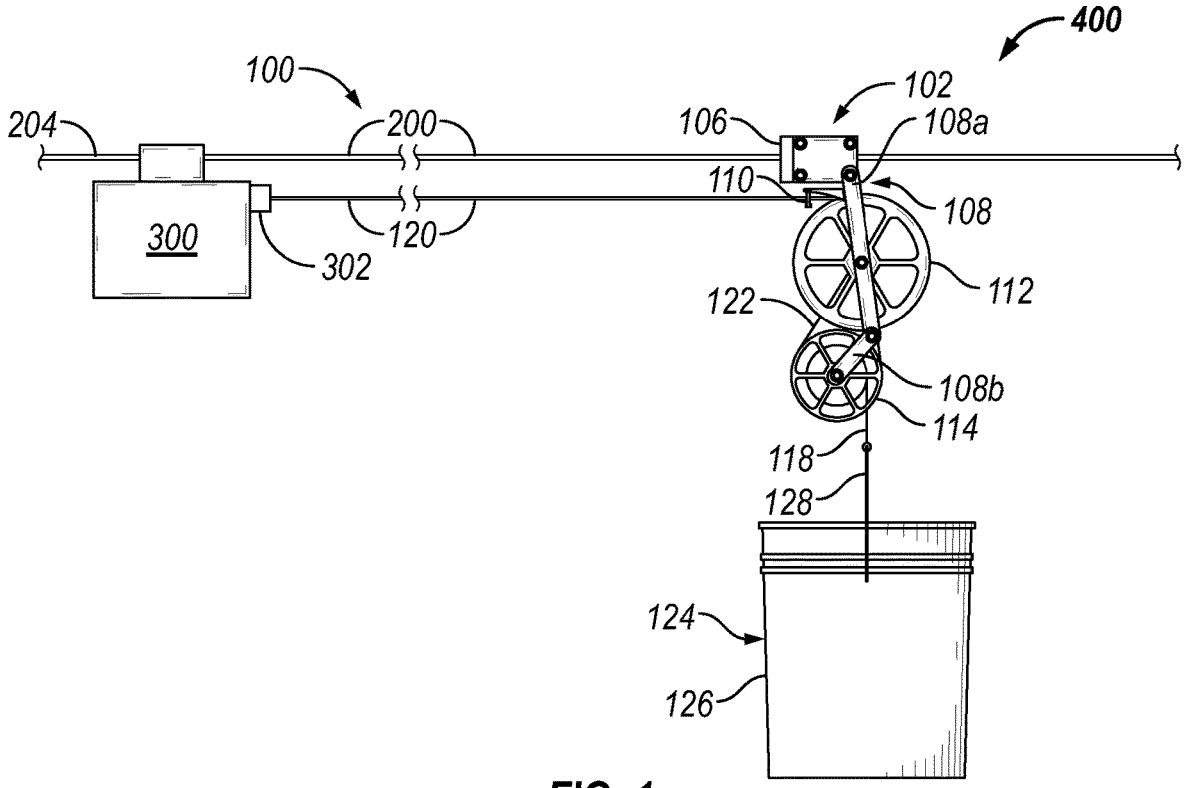
FIG. 1 illustrates a side view of an exemplary gravity-powered zip line trolley return system, in accordance with an illustrative embodiment of the present invention.

Referring initially to FIGS. 1-5 of the drawings, an illustrative embodiment of the gravity-powered zip line trolley return system, hereinafter system, is generally indicated by reference numeral 100. As illustrated in FIG. 1, the system 100 may be configured for attachment to a trolley 300 which is configured to traverse a zip line cable 200 of a zip line system 400 from a starting position 202 to an ending position 204 on the zip line cable 200 and automatically pull and return the trolley 300 from the ending position 204 back to the starting position 202 at the conclusion of each ride or traversal of the trolley 300 on the zip line cable 200. The system 100 may facilitate automatic return of the trolley 300 to the starting position 202 without requiring the application of electrical, hydraulic, and/or other power for the purpose. The trolley 300 may include but is not limited to any type of vehicle, enclosure, harness, seat, or other support or assembly which is capable of holding or supporting at least one rider, cargo and/or other item or items to be transported using the zip line system.

Figure 2:
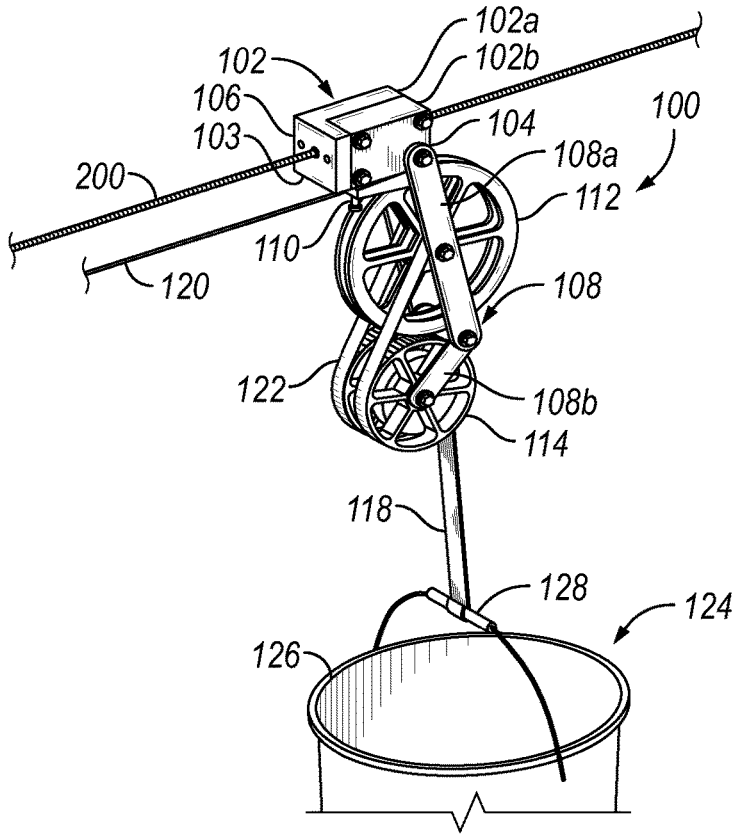
FIG. 2 illustrates a front perspective view, partially in section, of the exemplary gravity-powered zip line trolley return system shown in FIG. 1, in accordance with an illustrative embodiment of the present invention.

The system 100 may include a mounting block 102. The mounting block 102 may be configured to be mounted and immobilized at the upper end of the zip line cable 200 at the starting position 202 (FIG. 3) for the trolley 300 in traversal of the trolley 300 along the zip line cable 200 from the starting position 202 to the ending position 204 on the zip line cable 200, and back to the starting position 202. As illustrated in FIGS. 2 and 4, in some embodiments, the mounting block 102 may include a pair of mating mounting block components 102*a* and 102*b*. The mounting block components 102*a*, 102*b* may be positioned around the zip line cable 200 and clamped or secured to each other using mounting block fasteners 104 such as bolts and securing nuts, for example and without limitation, and/or other suitable attachment techniques known by those skilled in the art.

A cable slot 103 may be formed by and between the mating mounting block components 102*a*, 102*b* of the mounting block 102. The cable slot 103 may be suitably sized and configured to receive the zip line cable 200 between the mounting block components 102*a*, 102*b* for clamping of the zip line cable 200 therebetween upon deployment of the mounting block components 102*a*, 102*b* around the zip line cable 200 in assembly of the mounting block 102 thereon. In some embodiments, a resilient, elastomeric bumper 106, which may be rubber, for example and without limitation, may be attached to the leading surface of the mounting block 102 which faces the ending position 204 on the zip line cable 200.

In some embodiments, the mounting block 102 of the system 100 may be sized and configured to grip a zip line cable 200 having a diameter of 5/16" or larger without modification. In other embodiments, however, the mounting block 102 may be configured for deployment on a zip line cable 200 having any diameter. In some embodiments or applications, the zip line cable 200 may be wrapped with duct tape or like suitable material to impart the desired diameter to the zip line cable 200 to accord with the width of the cable slot 103 formed between the mounting block components 102*a*, 102*b*. Accordingly, variable lengths and widths of the cable slot 103 can be manufactured without departing from the scope and spirit of the present invention.

A spool bracket 108 may extend downwardly from the mounting block 102. In some embodiments, the spool bracket 108 may include a pair of elongated, parallel, spaced-apart, upper, first bracket portions 108*a*. The first bracket portions 108*a* of the spool bracket 108 may be attached to the mounting block 102 using suitable fasteners and/or other techniques known by those skilled in the art. A pair of spaced-apart, lower, second bracket portions 108*b* may extend downwardly from the respective first bracket portions 108*a*. The second bracket portions 108*b* may be attached to the respective first bracket portions 108*a* using suitable fasteners and/or other techniques known by those skilled in the art, or may be casted, molded or otherwise fabricated in one piece with the first bracket portions 108*a*. In some embodiments, the second bracket portions 108*b* may be disposed at an obtuse angle with respect to the respective first bracket portions 108*a* typically in the forward or downhill direction of the zip line cable 200. In some embodiments, the spool bracket 108 may be mounted at a lower corner of the mounting block 102 opposite the bumper 106.

An upper, first spool 112 may be rotatably mounted typically between the first bracket portions 108*a* of the spool bracket 108. A lower, second spool 114 may be rotatably mounted typically between the second bracket portions 108*b* beneath the first spool 112. The first spool 112 may have a greater diameter than that of the second spool 114.

A trolley return line 120 may be attached to the trolley 300. In some embodiments, the trolley return line 120 may be a high-strength, high-quality fishing line such as braided polyethylene (ePTFE), or polyamide polymer, for example and without limitation. The trolley return line 120 may be wound on the first spool 112. The trolley return line 120 may feed out from the rotating upper spool 120 with the trolley 300 as the trolley 300 traverses the zip line cable 200 from the starting position 202 to the ending position 204. In some embodiments, a trolley return line guide 110 may extend forwardly from the spool bracket 108. The trolley return line 120 may extend from the first spool 112 through the trolley return line guide 110 such that the trolley return line guide 110 maintains the trolley return line 120 in spaced-apart, parallel relationship to the zip line cable 200 as the mounting block 102 traverses the zip line cable 200.

As the trolley 300 traverses the zip line cable 200, considerable lengths of the trolley return line 120 may be wound onto the first spool 112. The weight of the trolley return line 120 may be selected to prevent the trolley return line 120 from sagging down below the zip line cable 200, where it may snag or tangle on the underlying ground or terrain (not illustrated) traversed by the zip line cable 200.

A counterweight 124 may be attached to the second spool 114, such as via at least one counterweight suspension element 118. In some embodiments, the counterweight suspension element 118 may include at least one webbing strap or cable, for example and without limitation, or other flexible material which can be wound on and unwound from the second spool 114. In some embodiments, the counterweight 124 may have a weight which can be selectively changed or altered by an operator of the zip line system 400. For example, and without limitation, in some embodiments, the counterweight 124 may include a counterweight container 126. The counterweight container 126 may be configured to receive and contain a quantity of sand, water and/or other weighting medium (not illustrated), the type and quantity of which can be selected for placement into the counterweight container 126 to attain the desired weight of the counterweight 124. A container handle 128 may extend from the counterweight container 126. The container handle 128 may be configured for attachment to the counterweight suspension element 118.

Figure 3:
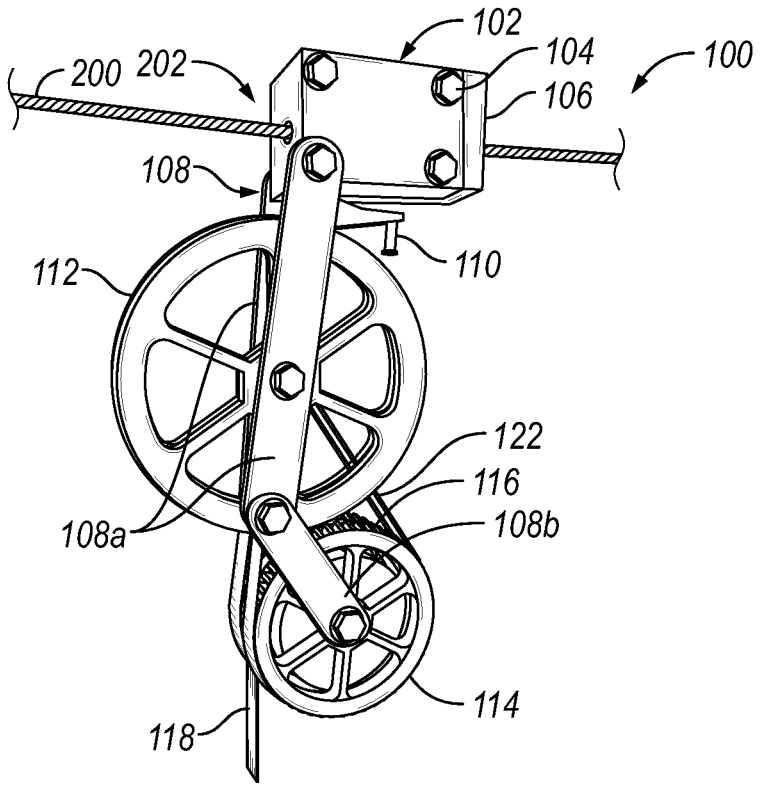
FIG. 3 illustrates a side view of an exemplary gravity-powered zip line trolley return system showing a typical gear reduction mechanism and belt drive with mounting of the system to the zip line cable, in accordance with an illustrative embodiment of the present invention.
Figure 4:
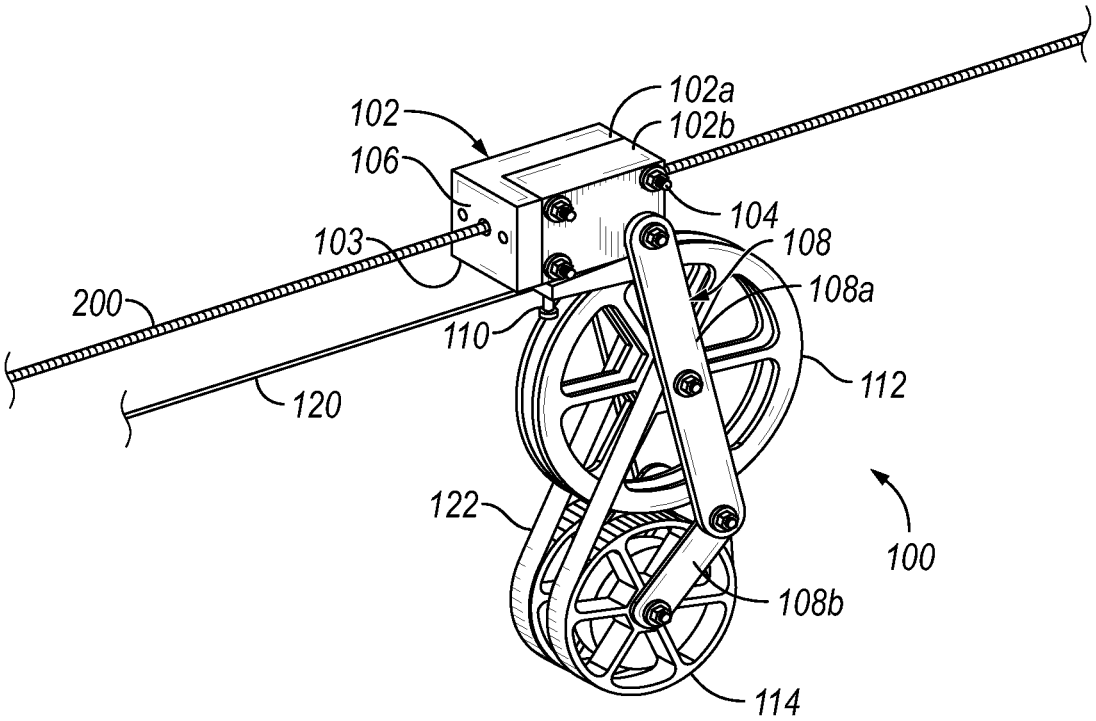
FIG. 4 illustrates a front perspective view of the exemplary gravity-powered zip line trolley return system showing a typical belt drive attached to the gear reduction mechanism of the system, in accordance with an illustrative embodiment of the present invention.

As illustrated in FIG. 3, a belt-driven gear reduction ratio mechanism 116 may be provided on the second spool 114. A belt drive 122 may drivingly couple the first spool 112 and the second spool 114 to each other via the gear reduction ratio mechanism 116. Accordingly, as the trolley 300 traverses the zip line cable 200 and draws out the trolley return line 120 from the rotating first spool 112, the first spool 112 may rotate the second spool 114 via the belt drive 122 and gear reduction ratio mechanism 116. The rotating second spool 114 may, in turn, lift the counterweight 124 via the counterweight suspension element 118. At the conclusion of the ride, a rider (not illustrated) may dismount from the trolley 300. The counterweight 124 may thus continue to pull downwardly on the counterweight suspension element 118, which rotates the second spool 114. The second spool 114 may rotate the first spool 112 via the belt drive 122 and gear reduction ratio mechanism 116 such that the trolley return line 120 is wound on the first spool 112. Thus, the winding trolley return line 120 may pull the trolley 300 along the zip line cable 200 from the ending position 204 back to the starting position 202. The gear reduction mechanism 116 may allow the counterweight 124 to travel in the short distance between the ground or terrain beneath the zip line cable 200 and the counterweight suspension element 118. The variable gear reduction ratio mechanism 116 may additionally minimize the resistance applied to the trolley 300 during the run.

In typical application of the system 100, the trolley 300 may initially be positioned at the starting position 202 at the elevated upper end of the zip line cable 200. The weight of the counterweight 124 may initially be set by placing the desired quantity or weight of water, sand and/or other weighting medium in the counterweight container 126 of the counterweight 124 to fine-tune and achieve the desired weight of the counterweight 124. At the beginning location of the trolley 300 at or near the starting position 202 on the zip line cable 200, the counterweight 124 may be disposed in the lowermost position with most or a large segment of the counterweight suspension element 118 unwound from the second spool 114.

At least one rider (not illustrated) may embark the trolley 300. Additionally, or alternatively, cargo and/or other items to be transported (not illustrated) may be placed in the trolley 300. The weight of the trolley 300 may thus overcome the weight of the counterweight 124 and traverse the zip line cable 200 from the starting position 202 toward the ending position 204 typically at the lower end of the zip line cable 200 under the influence of gravity.

As the trolley 300 traverses the zip line cable 200, the trolley return line 120 may unwind from the first spool 112 as the first spool 112 rotates. Simultaneously, the rotating first spool 112 may rotate the second spool 114 typically via the belt drive 122 and gear reduction ratio mechanism 116. The counterweight suspension element 118 may consequently wind onto the second spool 114 such that the counterweight suspension element 118 lifts or raises the counterweight 126 without restricting the smooth motion of the trolley 300 down the zip line cable 200.

When the trolley 300 reaches the ending position 204 on the zip line cable 200, the rider or riders and/or cargo or other items may be removed from the trolley 300. The counterweight 124 may continue to apply weight to the counterweight suspension element 118 such that the counterweight suspension element 118 pulls against and unwinds the counterweight suspension element 118 from the second spool 114. The second spool 114 may rotate the first spool 112 via the belt drive 122 and gear reduction ratio mechanism 116 as the trolley return line 120 is wound on the first spool 112. Consequently, the trolley return line 120 may pull the trolley 300 back to the starting position 202 preparatory to a subsequent journey down the zip line cable 200. Furthermore, the trolley 300 may return smoothly to reach the starting position 202 without crashing into the mounting block 102. In some cases, the trolley 300 may engage the bumper 106 on the mounting block 102 such that the bumper 106 cushions the contact between the trolley 300 and the mounting block 102. The trolley 300 is thus positioned to again descend the zip line cable 200 automatically and under the influence of gravity after a rider embarks the trolley 300 and/or as cargo or other items are placed on the trolley 300.

It will be appreciated by those skilled in the art that the system 100 of the present invention may be installed to operate without any user input. The system 100 may simply reset and reposition the trolley 300 to the starting position 202 for the subsequent use. This expedient may improve the safety, convenience, and operational efficiency of the zip line system 400.

It will be further appreciated by those skilled in the art that the counterweight suspension element 118 which suspends the counterweight 124 from the second spool 114 may be aligned in such a manner during installation of the system 100 that the counterweight 124 remains in a hanging position just few inches above the ground or terrain beneath the zip line cable 200. The gear ratio of the gear reduction ratio mechanism 116 may be selectively adjusted to match the travel of the counterweight 124 between the ground and the second spool 114 to the length of the zip line cable 200. The counterweight 124 may be near to the ground when the trolley 300 is at the starting position 202, and then raised to near the second spool 114 when the trolley 300 is at the ending position 204. The adjustment may be made by varying the length of the counterweight suspension element 118 on the second spool 114, which in turn changes the diameter it is spooling up on during operation. Further, the system 100 may allow the trolley return line 120 to run with the cable 200 in a minimum strain such that it does not contact the cable 200 and remains in parallel with the zip line cable 200 during the forward and return movement of the trolley 300 along the zip line cable 200. Further, the trolley return line 120 may run smoothly with the trolley 300 as the trolley 300 forwardly traverses the grip line cable 200.

Figure 5:
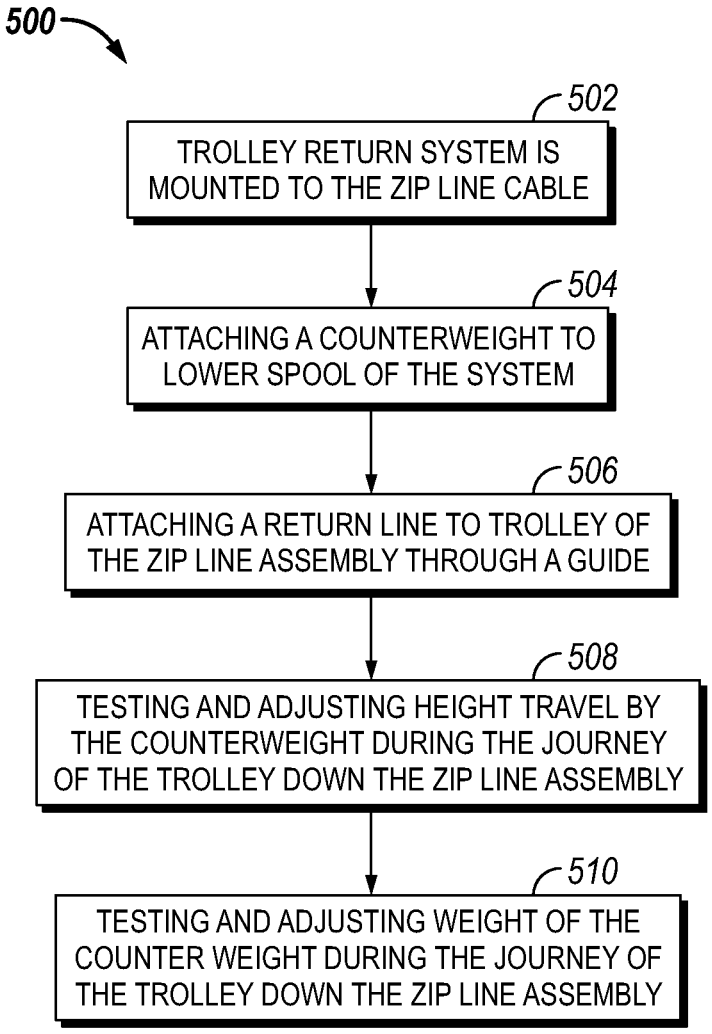
FIG. 5 illustrates a flow chart of an exemplary method of installation and operation of a gravity-powered zip line trolley return system, in accordance with an illustrative embodiment of the present invention.

Referring next to FIG. 5 of the drawings, an illustrative embodiment of a method 500 for mounting the trolley return system 100 to a zip line cable 200 is disclosed. According to a first step 502 of the method 500, the system 100 may be mounted to the zip line cable 200 wherein the mounting block 102 is detachably mounted at or adjacent to the upper end of the main zip line cable 200 at or adjacent to the starting position 202 of the trolley 300. The bumper 106 may be attached to the mounting block 102 in a downwardly facing position with respect to the zip line cable 200. In an exemplary embodiment, the mounting block 102 may be designed to grip the grip line cable 200. Thereafter, a spool bracket 108 on which is mounted a first spool 112 and a second spool 114 may be detachably mounted to the lower corner of the mounting block 102 opposite the bumper 106, thereby ensuring that the trolley return line guide 110 faces down the zip line cable 200, as shown in FIG. 1. The mounting block 102 may be evenly tightened to grip the zip line cable 200 securely. The system 100 may be attached to the zip line cable 200 such that the system 100 pivots freely thereon; if needed, the mounting block fasteners 104 may be loosened until the mounting block 102 is movable on the zip line cable 200.

A second step 504 of the method 500 may include attaching a counterweight 124 to the counterweight suspension element 118 attached to the second spool 114, wherein the counterweight suspension element 118 is adjustably attached to the counterweight 124 while the counterweight 124 rests on the ground (or platform), is directly beneath the second spool 114. One end of the counterweight suspension element 118 may be secured to the counterweight 124, and the other end of the counterweight suspension element 118 may be wound onto the second spool 114. For example, initially a bucket or a container (not illustrated) may be used to place or pour the water, sand and/or other weighting medium (not illustrated) into the counterweight container 126 for ease of fine-tuning the desired weight of the counterweight 124. In some applications, a more compact material or weighted object or objects, such as disk weights, for example and without limitation, may be used as the counterweight 124 or placed into the counterweight container 126. For example, a loop (not illustrated) on the extending end of the counterweight suspension element 118 may be attached to the handle or handles of one or more water jugs, the center of a barbell weight, etc. Once the desired length of the counterweight suspension element 118 is determined, the excess length of the counterweight suspension element 118 may be rolled up and secured to the second spool 114 using a zip tie (not illustrated) or another suitable securing device. At this point, a few inches of water (typically less than half a gallon) may be placed in the counterweight container 126 of the counterweight 124. Both the first spool 112 and the second spool 114 may be threaded from the rear such that that applied tension may tighten the first spool 112 and the second spool 114 against the counterweight suspension element 118.

A third step 506 of the method 500 may include attaching the trolley return line 120 to the trolley 300 typically through a trolley return line guide 110. The first spool 112 may be rotated several times in the feed-out direction until the counterweight 124 has been lifted and suspended an inch or two off the ground or terrain beneath the zip line cable 200. At this point, the counterweight suspension element 118 may be removed from the second spool 114 and the trolley return line 120 held in place and then threaded through the trolley return line guide 110. The trolley return line 120 may then be attached to zip line trolley 300. As illustrated in FIG. 1, the trolley return line 120 may run as parallel as possible to the cable 200 and may be attached to a built-in trolley component 302, such as a handlebar or carabiner, for example and without limitation, attached directly to the trolley 300.

A fourth step 508 of the method 500 may include assessing the height travel by the counterweight 124 during the journey of the trolley 300 down the zip line cable 200. Gravity may pull the trolley 300 down the zip line cable 200 to the ending position 204 on the zip line cable 200. The counterweight 124 may have sufficient room to travel vertically as the trolley return line 120 is spooled out from the first spool 112 without the counterweight 124 contacting the second spool 114. If the counterweight 124 contacts the second spool 114 before the trolley 300 reaches the ending position 204 during travel down the zip line cable 200, the gear ratio of the system and the weight of the counterweight 124 may need to be reconfigured.

A fifth step 510 of the method 500 may include tuning the counterweight 124 as per the travel of the counterweight 124 observed in the above step 508, and thereafter allowing the trolley 300 to settle, and mounting the trolley 300 in the low point of the zip line cable 200 (typically about ¾ of the way down the zip line cable 200). If the trolley 300 is already being pulled back up the zip line cable 200 by the counterweight 124, some of the weight medium (sand, water, etc.) may be removed from the counterweight container 126 of the counterweight 124 until the trolley 300 remains in place on the zip line cable 200. From this point, weight medium may slowly be added to the counterweight container 126, and this addition may be paused when the trolley 300 begins to travel back up the zip line cable 200. Weight medium can be added or removed, as needed, to adjust the speed of return of the trolley 300. Upon smooth return of the trolley 300 to the starting position 202, installation of the trolley return system 100 may be completed and the method 500 of one cycle of operation of the trolley return system 100 implemented.

If the heretofore described travel test indicates that the counterweight 124 has insufficient travel at its maximum gear ratio, that is, that the second spool 114 contacts the counterweight 124 before the trolley return line spools 120 out completely from the first spool 112, then the system 100 may be reconfigured to utilize a larger counterweight 124 that travels half the distance. The counterweight suspension element 118 may be doubled back to the frame using a double cam strap and hanging the counterweight 124 in the created loop. Although this doubles the weight of the counterweight 124, the travel distance of the counterweight 124 is halved. The counterweight 124 may slide in the loop as it travels such that a low-friction connection using bearings, or alternatively, a pulley may be used.

According to another embodiment, if the distance between the spool 114 and the counterweight 124 is large when the trolley return line 120 spools out completely, then the amount of weight of the counterweight 124 may be reduced and a few extra turns of the counterweight suspension element may be added to connect the spool 114 and the counterweight 124. For example, the counterweight 124 may be detached and the counterweight suspension element 118 may be fed a few more times around the second spool 114 before reattaching the counterweight suspension element 118 to the counterweight 124. This will increase the travel distance of the counterweight 124 and reduce the mass of the counterweight 124 which is required for operation. Further, the travel distance of the counterweight 124 may be adjusted by adjusting the weight of the counterweight 124 and the number of turns of the counterweight suspension element 118 which attach to the counterweight 124 to the second spool 114 to walk the trolley 300 down the zip line assembly 400 to the ending position 204 while optimizing the travel distance of the counterweight 124 close to the second spool 114.

According to an aspect of the present invention, a gravity-powered zip line trolley return system 100 for a zip line system 400 having a zip line cable 200 and a trolley 300 configured to traverse the zip line cable 200 may include a mounting block 102 detachably mountable to the zip line cable 200 of the zip line system 400; a spool bracket 108 supported by the mounting block 102; a first spool 112 supported by the spool bracket 108; a second spool 114 supported by the spool bracket 108, wherein the first spool 112 and the second spool 114 are rotationally coupled to each other through a gear reduction ratio mechanism 116 and a drive belt 122; a trolley return line 120 windable on the first spool 112 and connectable to the trolley 300 of the zip line system 400, the trolley return line 120 configured to move with the trolley 300 in a forward movement and to pull the trolley 300 in a backward movement as the first spool 112 rotates; a counterweight suspension element 118 windable on the second spool 114; and a counterweight 124 attached to the counterweight suspension element 118, further the counterweight suspension element 118 balances the counterweight 124 against gravity depending on rotation of the gear reduction ratio mechanism 116 with respect to the forward or backward movement of the trolley return line 120 with the trolley 300.

According to another aspect of the present invention, the system 100 may further include a rubber or other resilient or elastomeric bumper 106 attached to a front side of the mounting block 102 to cushion the mounting block 102 of the system 100 as the trolley 300 returns to the starting point 202.

It is an objective of the present invention is to provide a gravity-powered zip line trolley return system 100 that automatically returns a trolley 300 to a starting position 202 without application of external power.

It is another objective of the present invention is to provide a gravity-powered zip line trolley return system 100 that is easy to install and low cost and is a minimal maintenance system that automatically returns the trolley 300 to the starting position 202.

It is another objective of the present invention is to provide a gravity-powered zip line trolley return system 100 that improves the safety, convenience, and operational efficiency of a zip line system.

It is another objective of the present invention to provide a gravity-powered zip line trolley return system 100 that saves time and effort to return back the trolley 300 to a starting position 202 of the zip line system.

These and other objectives and advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A gravity-powered zip line trolley return system for a zip line system having a zip line cable and a trolley configured to traverse the zip line cable, wherein the zip line trolley return system comprises:

a mounting block detachably mountable to the zip line cable of the zip line system;

a spool bracket supported by the mounting block;

a first spool supported by the spool bracket;

a second spool supported by the spool bracket, wherein the first spool and the second spool are rotationally coupled to each other through a gear reduction ratio mechanism and a drive belt;

a trolley return line windable on the first spool and connectable to the trolley of the zip line system, the trolley return line configured to move with the trolley in a forward movement and to pull the trolley in a backward movement as the first spool rotates;

a counterweight suspension element windable on the second spool; and a counterweight attached to the counterweight suspension element, further the counterweight suspension element balances the counterweight against gravity depending on rotation of the gear reduction ratio mechanism with respect to the forward or backward movement of the trolley return line with the trolley.

2. The gravity-powered zip line trolley return system according to claim 1 further comprising a resilient bumper on the mounting block.

3. The gravity-powered zip line trolley return system of claim 1 wherein the first spool has a diameter greater than a diameter of the second spool.

4. The gravity-powered zip line trolley return system of claim 1 further comprising a trolley return line guide on the mounting block, and wherein the trolley return line extends from the first spool through the trolley return line guide.

5. The gravity-powered zip line trolley return system of claim 1 wherein the trolley return line comprises braided polyethylene.

6. The gravity-powered zip line trolley return system of claim 1 wherein the counterweight suspension element comprises at least one webbing strap.

7. The gravity-powered zip line trolley return system of claim 1 further comprising a cable slot in the mounting block, and wherein the cable slot is sized and configured to receive the zip line cable of the zip line system.

8. The gravity-powered zip line trolley return system of claim 1 wherein the spool bracket comprises a pair of spaced-apart first bracket portions carried by the mounting block and a pair of spaced-apart second bracket portions extending from the first bracket portions, respectively, the second bracket portions disposed at an obtuse angle to the first bracket portions, respectively, and wherein the first spool is rotatably mounted between the first bracket portions and the second spool is rotatably mounted between the second bracket portions of the spool bracket.

9. A gravity-powered zip line trolley return system for a zip line system having a zip line cable and a trolley configured to traverse the zip line cable, wherein the zip line trolley return system comprises:

a mounting block detachably mountable to the zip line cable of the zip line system, the mounting block having a pair of mating mounting block components configured to be secured to each other and clamped onto the zip line cable of the zip line system;

a spool bracket supported by the mounting block;

a first spool supported by the spool bracket proximate the spool bracket;

a second spool supported by the spool bracket proximate the first spool;

a gear reduction ratio mechanism on the second spool;

a belt drive drivingly coupling the first spool and the second spool to each other via the gear reduction ratio mechanism;

a trolley return line windable on the first spool and connectable to the trolley of the zip line system, the trolley return line configured to move with the trolley in a forward movement and to pull the trolley in a backward movement as the first spool rotates;

a counterweight suspension element windable on the second spool, the counterweight suspension element including at least one webbing strap; and a counterweight attached to the counterweight suspension element, further the counterweight suspension element balances the counterweight against gravity depending on rotation of the gear reduction ratio mechanism with respect to the forward or backward movement of the trolley return line with the trolley.

10. The gravity-powered zip line trolley return system according to claim 9, further comprising a resilient bumper on the mounting block.

11. The gravity-powered zip line trolley return system of claim 9 wherein the first pool has a diameter greater than a diameter of the second spool.

12. The gravity-powered zip line trolley return system of claim 9 further comprising a trolley return line guide on the mounting block, and wherein the trolley return line extends from the first spool through the trolley return line guide.

13. The gravity-powered zip line trolley return system of claim 9 wherein the trolley return line comprises braided polyethylene.

14. The gravity-powered zip line trolley return system of claim 9 wherein the counterweight suspension element comprises at least one webbing strap.

15. The gravity-powered zip line trolley return system of claim 9 further comprising a cable slot in the mounting block, and wherein the cable slot is sized and configured to receive the zip line cable of the zip line system.

16. The gravity-powered zip line trolley return system of claim 9 wherein the spool bracket comprises a pair of spaced-apart first bracket portions carried by the mounting block and a pair of spaced-apart second bracket portions extending from the first bracket portions, respectively, the second bracket portions disposed at an obtuse angle to the first bracket portions, respectively, and wherein the first spool is rotatably mounted between the first bracket portions and the second spool is rotatably mounted between the second bracket portions of the spool bracket.

17. A gravity-powered zip line trolley return system for a zip line system having a zip line cable and a trolley configured to traverse the zip line cable, wherein the zip line trolley return system comprises:

a mounting block detachably mountable to the zip line cable of the zip line system, the mounting block having a pair of mating mounting block components configured to be secured to each other and clamped onto the zip line cable of the zip line system;

a resilient bumper on the mounting block;

a spool bracket supported by the mounting block;

a first spool supported by the spool bracket proximate the spool bracket;

a second spool supported by the spool bracket proximate the first spool;

wherein the first spool has a diameter greater than a diameter of the second spool;

a gear reduction ratio mechanism on the second spool;

a belt drive drivingly coupling the first spool and the second spool to each other via the gear reduction ratio mechanism;

a trolley return line windable on the first spool and connectable to the trolley of the zip line system, the trolley return line configured to move with the trolley in a forward movement and to pull the trolley in a backward movement as the first spool rotates;

a counterweight suspension element windable on the second spool; and a counterweight including a counterweight container attached to the counterweight suspension element, further the counterweight suspension element balances the counterweight against gravity depending on rotation of the gear reduction ratio mechanism with respect to the forward or backward movement of the trolley return line with the trolley.

18. The gravity-powered zip line trolley return system of claim 17 further comprising a cable slot in the mounting block, and wherein the cable slot is sized and configured to receive the zip line cable of the zip line system.

19. The gravity-powered zip line trolley return system of claim 17 wherein the spool bracket comprises a pair of spaced-apart first bracket portions carried by the mounting block and a pair of spaced-apart second bracket portions extending from the first bracket portions, respectively, the second bracket portions disposed at an obtuse angle to the first bracket portions, respectively, and wherein the first spool is rotatably mounted between the first bracket portions and the second spool is rotatably mounted between the second bracket portions of the spool bracket.

20. The gravity-powered zip line trolley return system of claim 17 wherein the trolley return line comprises braided polyethylene.

* * * * *